US005495633A

United States Patent [19]

Speer

[11] Patent Number: 5,495,633

[45] Date of Patent: Mar. 5, 1996

[54] PORTABLE ANTI-STATIC DEVICE

[76] Inventor: Kandi L. Speer, 9323 S. Oxford Ave., Tulsa, Okla. 74137-4130

[21] Appl. No.: 76,593

[22] Filed: Jun. 14, 1993

[51] Int. Cl.[6] ..... H05F 1/00; H05F 3/00

[52] U.S. Cl. ..... 15/104.94; 15/1.52; 401/196; 401/202

[58] Field of Search ..... 15/104.93, 104.94, 15/1.51, 1.52, 104.002; 401/196, 202

[56] References Cited

U.S. PATENT DOCUMENTS

| | | | |
|---|---|---|---|
| 583,701 | 6/1897 | Farwick | 401/202 |
| 3,421,170 | 1/1969 | Thomas, Jr. | 15/104.002 |
| 3,485,502 | 12/1969 | Thornton | 15/104.93 X |
| 4,084,286 | 4/1978 | Post | 15/104.93 |
| 4,627,936 | 12/1986 | Gould et al. | 15/104.93 X |

FOREIGN PATENT DOCUMENTS

| | | | |
|---|---|---|---|
| 214916 | 11/1956 | Australia | 15/104.93 |
| 1062453 | 7/1959 | Germany | 15/1.52 |
| 2730266 | 1/1979 | Germany | 15/104.93 |
| 496723 | 3/1992 | Japan | 15/1.51 |

*Primary Examiner*—Steven A. Bratlie

*Attorney, Agent, or Firm*—Frank J. Catalano; Scott R. Zingerman

[57] ABSTRACT

This describes a portable non-pressurized anti-static device for eliminating static cling on clothes on which static electricity has built up. An absorbent material impregnated with an anti-static solution is supported by a frame. A cover, when in place, prevents the anti-static solution from being rubbed off or otherwise removed from the absorbent material until it is ready to be used. When static cling occurs, the wearer removes the cover and rubs the impregnated material against the area of the clothes affected, thereby removing the static electricity.

2 Claims, 2 Drawing Sheets

PORTABLE ANTI-STATIC DEVICE

INVENTION DISCLOSURE STATEMENT BY APPLICANT

No patentability search has been conducted on this disclosure. Applicant knows of no prior art more pertinent than that disclosed in the application. Further, Applicant knows of no portable non-pressurized anti-static device.

BACKGROUND OF THE INVENTION

This invention relates to the removal of static electricity from clothing. More particularly, it relates to a portable anti-static device.

Static (static electricity) buildup on clothing is a major inconvenience and sometimes embarrassment to people—both men and women. The static buildup is especially prevalent in cold, dry weather. The static buildup is especially bad on many materials, including wool and some manmade fibers.

When static builds up on clothing, it can cause embarrassing situations, especially for women when their dress may be clinging to certain parts of their anatomy and exposing other parts, and in general not letting the clothes hang in the graceful and attractive flow for which they were tailored.

Static buildup is also quite prevalent on some carpets. Various solutions have been developed and sold commercially for spraying carpets and clothing with a solution to remove the static charge. One such solution is sold in an aerosol can under the trademark "STATIC GUARD®" by Alberto-Culver Company, Melrose Park, Ill. and contains Dimethyl Ditallow Ammonium Chloride.

There are also anti-static devices sold in sheets for putting with clothes in clothes dryers. One such anti-static device is sold under the trademark "BOUNCE®" by Proctor and Gamble. Other brands include "SNUGGLE®" of Lever Brothers. This seems to work reasonably well. However, people still suffer from static cling on their clothing which is disconcerting to say the least. It is thus clear that such a victim of static cling needs help and needs it the moment the static cling appears, especially if it is at a dinner party or other social event.

When a person gets lint on one's clothes, there are lint pickup devices available such as adhesive rollers sold under the trademark "LINT PICKUP®" by Helmac Products Corporation, Flint, Mich. This, of course, may remove lint but is of no comfort to one suffering from static cling, especially if they are attending an important ball, banquet, or other social function.

It is an object of this invention to disclose a portable anti-static device. It is a further object to provide such a device that is portable and of such size and non-aerosol so as to fit safely into one's pocket or purse so that it is readily available in the event of any clothing static-related crisis.

SUMMARY OF THE INVENTION

This is a portable anti-static device for eliminating static, especially in one's clothing. A preferred embodiment includes an absorbent material and a holding or frame means for supporting the absorbent material. The absorbent material is impregnated by an anti-static solution. In an especially preferred embodiment, there is provided a cover over the absorbent material.

One carries the portable anti-static device in one's purse or pocket. When static cling occurs, one merely takes the device from such purse or pocket, and removes the cover, thus exposing the absorbent material with the anti-static solution impregnated therein. Then, one holds the device by the frame or handle and manipulates the absorbent material over and in contact with the area where the static cling occurs. Anti-static solution comes off the absorbent material by friction caused by the rubbing and is transferred to the clothing at the area of contact. This removes the static from that area and eliminates the static cling. The anti-static solution is under no pressure and can be safely carried in one's purse or pocket. The abosrbent material may be replaced, resoaked or recharged with anti-static solution.

BRIEF DESCRIPTION OF THE DRAWINGS

Other objects and advantages of the invention will become apparent upon reading the following detailed description and upon reference to the drawings in which.

DESCRIPTION OF THE PREFERRED EMBODIMENT

Figure 1:
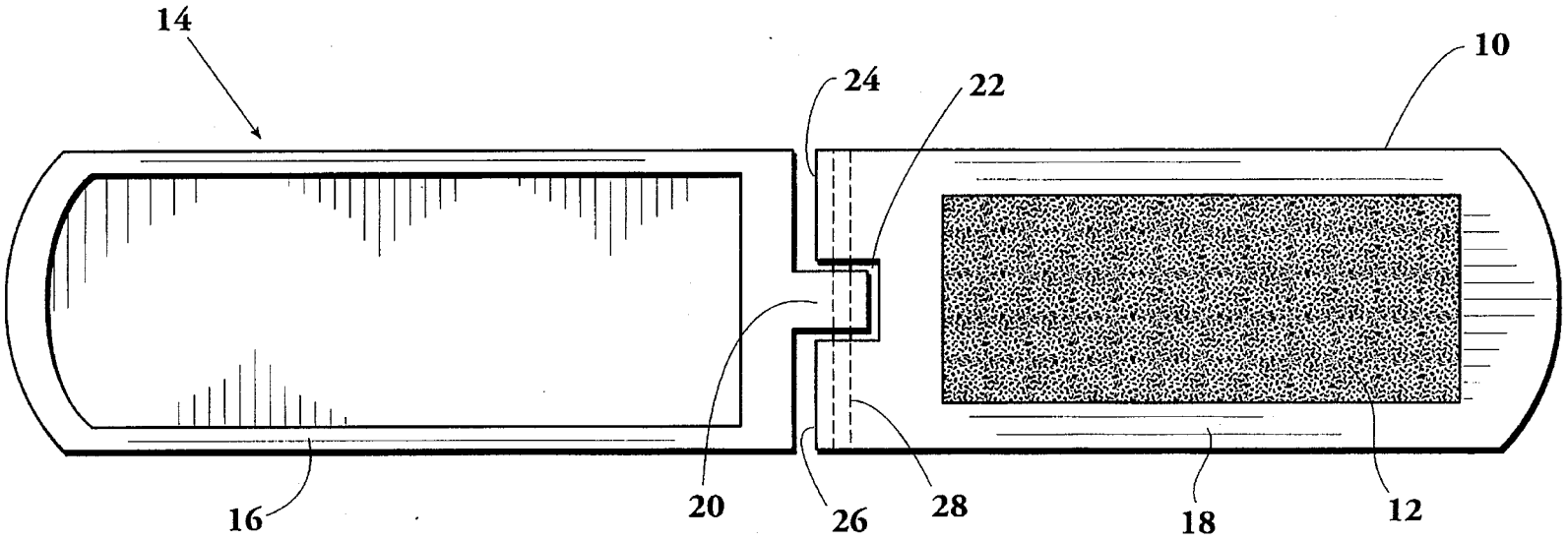
FIG. 1 illustrates a top view of one embodiment of a portable anti-static device having a hinged cover.
Figure 2:
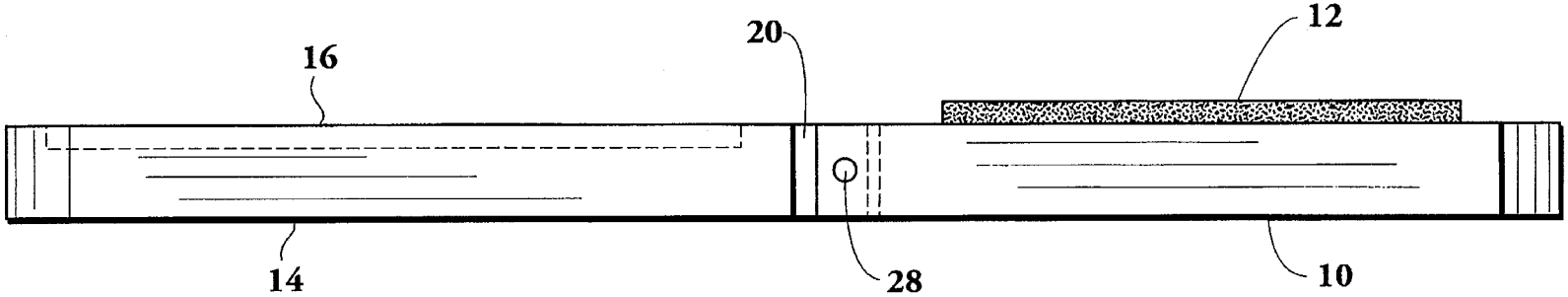
FIG. 2 is a side view of the device of FIG. 1.

Attention is next directed to FIGS. 1 and 2 which show one preferred embodiment although other embodiments can be used with equal effectiveness. Shown therein is a frame 10 having an absorbent material 12 supported therefrom. The absorbent material 12 is impregnated by an anti-static solution. One such anti-static solution is Dimethyl Ditallow Ammonium Chloride such as contained in a product sold under the trademark "STATIC GUARD®" which is commercially available. The material 12 can be essentially any absorbent material which would hold or absorb a suitable amount of the anti-static solution. A cover 14 is hingedly attached to frame 10 so that it may be folded into a cover over the absorbent material 12. The cover 14 preferably has a lip 16 which fits along area 18 of the frame 10 when the cover is closed over the absorbent material. The hinge means between the frame 10 and the cover 14 includes a tongue 20 of cover 14 which fits into a space 22 between shoulders 24 and 26 of frame 10. A pin 28 holds the tongue 20 in position with respect to shoulders 24 and 26. There is a tight fit between the pin 28 and the tongue 20, with the tightness being such that the device will stay closed when placed in that position or stay open when placed in the open position unless forced into a different position. Of course, various forms of hinges can be used. Conversely, the cover 14 could be of size to fit snugly over frame 10; and by omitting the pin, the cover could be taken off and on from the snug fit. However, it is considered that the pin hinge is preferred because the cover is always readily available to cover the absorbent material. Except when used to remove static, the cover should be used to conserve the anti-static solution.

In this very practical use, the device described above in regard to FIGS. 1 and 2 is first closed with the cover 14 over the frame 10. It is then placed into one's purse or pocket. This anti-static device is especially useful in cold, dry weather. In fact, in such climatic conditions one would not want to leave home without this portable anti-static device. When one's clothes has a static cling attack, that person would take out the anti-static device, open the cover 14, and manipulate the device so that the absorbent material 12 contacts the affected area of the clothing. Some anti-static solution is removed from the absorbent material by friction and is transferred to the clothing portion contacted. This eliminates static cling of the clothing and permits clothing to fall or freely hang from the person's body to project the style of clothing in the manner in which the person making the clothing intended. The use of this portable anti-static device can eliminate an embarrassing or at least an awkward situation. The wearer is now at ease, knowing that his or her clothes will project a graceful appearance. The fact that this anti-static solution is under no pressure increases its safety.

Figure 3:
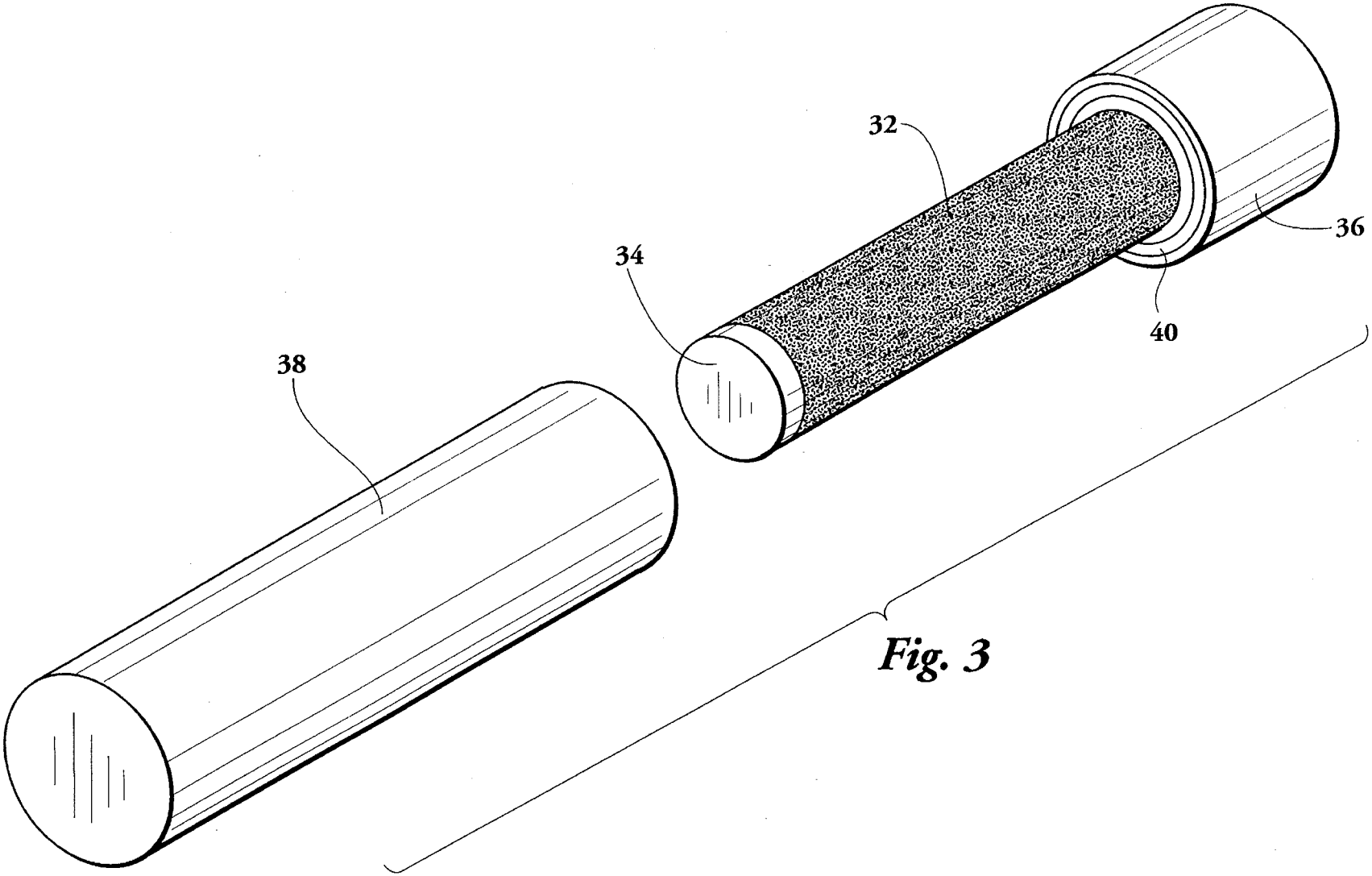
FIG. 3 shows another configuration of a portable anti-static device of this invention.

Attention is now directed to FIG. 3 which shows another embodiment of my portable anti-static device. Shown thereon is an absorbent material 32 supported about a cylinder 34 having handle 36 at one end thereof. The material 32 can be similar to that material 12 used in FIG. 1. An anti-static solution is used to impregnate the material 32. The solution may be the same as that used to impregnate material 12 in FIG.1. A cover 38 which is a hollow cylinder fits snugly over the material 32 and prevents inadvertent contact between absorbent material 32 and one's purse or pocket when it is thus carried. The end of cover 38 can fit into groove 40 of handle 36 and is positioned in the groove 40 such that when cover 38 fits snugly therein, the cover 38 is not in contact with the absorbent material 32.

The portable anti-static device of FIG. 3 with the cover 38 attached and extended into Groove 40 of handle 36 is carried by the potential user. When the need for the use of this device occurs, one may take it out of one's pocket, remove cover 38, and rub the absorbent material 32 against the affected area of the clothing. This is a silent operation with no hissing sound which accompanies aerosol containers being used. It is also less apt to put unwanted vapors in the air when used. A sufficient amount of the anti-static solution is used to contact the affected area of clothing to remove the static. Then cover 38 is repositioned on the device, and the device is again put into one's pocket.

While the invention has been described with a certain degree of particularity, it is manifest that many changes may be made in the details of construction without departing from the spirit and scope of this disclosure. It is understood that the invention is not limited to the embodiment set forth herein for purposes of exemplification, but is to be limited only by the scope of the attached claim or claims, including the full range of equivalency to which each element thereof is entitled.

What is claimed is:

1. A portable anti-static device for removing static electricity from a person's clothing which comprises:

a cylindrical holding means;

an absorbent material supported on the exterior of said cylindrical holding means;

an anti-static material impregnated into said absorbent material;

a cylindrical cover of larger diameter size than said cylindrical holding means for covering the absorbent material;

a handle at one end of said cylindrical holding means with a circular groove therein;

the size of the holding means, cover, and groove are such that when one end of said cover is fitted into said groove, the cover is not in contact with the absorbent material.

2. A portable anti-static device for removing static electricity from a person's clothing which comprises:

an absorbent material in fixed configuration;

a single non-cylindrical holding means holding all of said absorbent material said absorbent material extending above the surface of said holding means;

an anti-static solution impregnated into said absorbent material; and a substantially flat cover means separate from and hingedly attached to said holding means to cover the absorbent material on said holding means and to be used as a handle when absorbent material is uncovered, said cover means having a recess for receiving that portion of the absorbent material extending above the holding means.

* * * * *